United States Patent [19]

Kaufmann

[11] Patent Number: 4,664,092

[45] Date of Patent: May 12, 1987

[54] DISTRIBUTORLESS IGNITION SYSTEM FOR A FIVE CYLINDER FOUR STROKE INTERNAL COMBUSTION ENGINE

[75] Inventor: Reinhold Kaufmann, Oberriexingen, Fed. Rep. of Germany

[73] Assignee: Robert Bosch GmbH, Stuttgart, Fed. Rep. of Germany

[21] Appl. No.: 772,631

[22] Filed: Sep. 5, 1985

[30] Foreign Application Priority Data

Oct. 17, 1984 [DE] Fed. Rep. of Germany ..... 3438009

[51] Int. Cl.[4] ..... F02P 3/04

[52] U.S. Cl. ..... 123/643; 123/640

[58] Field of Search ..... 123/643, 640, 146.5 A

[56] References Cited

U.S. PATENT DOCUMENTS 3,910,247 10/1975 Hartig ..... 123/643

4,365,602 12/1982 Stiller et al. ..... 123/643

FOREIGN PATENT DOCUMENTS 58-77168 5/1983 Japan ..... 123/643

*Primary Examiner*—Andrew M. Dolinar

*Attorney, Agent, or Firm*—Frishauf, Holtz, Goodman & Woodward

[57] ABSTRACT

The ignition system of a five-cylinder gasoline engine utilizes two ignition coils, each serving two cylinders which are fired at instants of the firing sequence which are separated by the firing of one of the cylinders served by the other of these ignition coils. A third ignition coil fires only the remaining cylinder. The sparkplugs of two cylinders fired by the same ignition coil are connected through oppositely poled diodes. This arrangement avoids circuit closing sparks when either of the twin primary windings of the ignition coils serving two cylinders is turned on. There are thus five separate primary windings and only three separate secondary windings, and the former are turned on and off by individual electronic switching circuits triggered in sequence by individual pulse generators responsive to a magnet on a single rotary disc.

6 Claims, 2 Drawing Figures n
2n
M
R

DISTRIBUTORLESS IGNITION SYSTEM FOR A FIVE CYLINDER FOUR STROKE INTERNAL COMBUSTION ENGINE

This invention concerns a five cylinder, four stroke internal combustion engine of the electric ignition type in which the distribution of spark pulses to the several cylinders is performed without the use of movable parts, which is to say without the conventional ignition distributor unit. It has become known from automobile service station establishments that each of the five spark plugs located in the respective five cylinders of such an engine can be provided with an individual ignition coil provided with arrangements for switching the several ignition coils on and off in the rhythm of the required ignition sequence. The provision of these five ignition coils produces an assembly of great weight, substantial expense of material and large space requirements, with the result that this service station ignition system is poorly suited to meet the requirements of an ingition system built into the engine of a motor vehicle.

SUMMARY OF THE INVENTION

It is an object of the invention to provide a distributorless ignition system for a five cylinder engine that is economical and effective. Briefly, the system has three ignition coils, one of them serving a single cylinder and each of the other two serving a pair of cylinders. The ignition coils, of which each serve a pair of cylinders, each have the high potential terminal of the secondary winding connected to the two sparkplugs of the respective cylinders through diodes that are oppositely poled, and each have two primary windings arranged to be alternately excited in opposite directions of magnetic polarity. The ignition coil serving a single cylinder preferably has the high voltage terminal of its secondary winding also connected through a diode to the sparkplug of the cylinder in question.

BRIEF DESCRIPTION OF THE DRAWINGS

Further features of the invention are explained in the following description provided by way of illustrative example with reference to the annexed drawings, in which.

DESCRIPTION OF THE ILLUSTRATED EMBODIMENT

Figure 1:
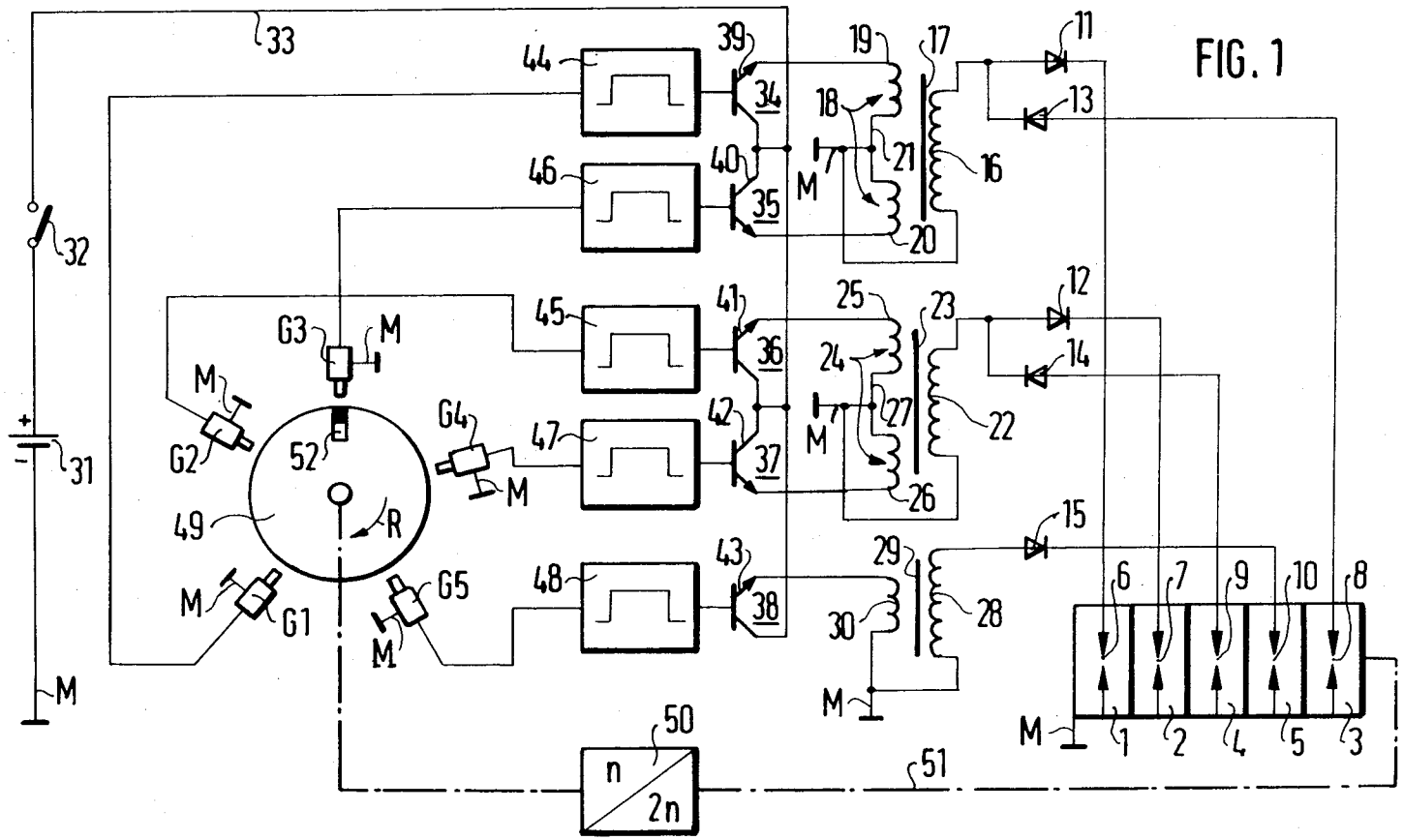
FIG. 1 shows a block circuit diagram of an ignition system according to the invention.

The ignition system shown in FIG. 1 is designed to serve a five cylinder four stroke gasoline engine of a motor vehicle. The reference numerals 1 to 5 respectively designate the cylinders in their firing order. A sparkplug 6 is provided in the cylinder 1, a sparkplug 7 in cylinder 2, a sparkplug 8 in cylinder 3, a sparkplug 9 in cylinder 4 and a sparkplug 10 in cylinder 5. One connection of each of the sparkplugs is grounded to the engine block and vehicle chassis as shown at M. The grounded terminal of the sparkplug 6 is connected to the cathode connection of a diode 11, the ungrounded connection of the sparkplug 7 to the cathode connection of a diode 12, the ungrounded connection of a sparkplug 8 to the anode connection of a diode 13, the ungrounded connection of a sparkplug 9 with the anode connection of a diode 14 and the ungrounded connection of the sparkplug 10 with the cathode connection of a diode 15.

The anode connection of the diode 11 and the cathode connection of the diode 13 go the high voltage terminal of the secondary winding 16 that is inductively coupled to the pair of primary windings 18 found on the same core 17 on which the secondary 16 is wound. The individual windings 19 and 20, of the winding pair designated 18, have a common connection which is grounded and connected to the low voltage terminal of the secondary winding 16.

The anode connection of the diode 12 and the cathode connection of the diode 14 are connected to the high voltage terminal of a secondary winding 22 that is also wound on a core on which a pair of primary windings, to which the secondary winding is inductively coupled, are wound. Thus, the primary winding pair 24, composed of the individual windings 25 and 26, are wound on the same core 23 as the the secondary winding 22 and have a common grounded connection 27 which is connected to the low voltage terminal of the secondary winding 22.

The anode connection of the diode 15 is connected to the high voltage terminal of the secondary winding 28 wound on a core 29, on which is also wound a single primary winding 30 to which the secondary winding 28 is inductively coupled. The low voltage terminal of the secondary winding 28 is connected to a grounded terminal of the primary winding 30.

The ignition system is supplied with direct current by the vehicle battery 31 of which the negative pole is grounded at M and the positive pole connected through an ignition switch 32 to a voltage supply line 33. The latter is connected to the ungrounded terminal of the primary winding 19 through an interrupter 34, to the ungrounded terminal of the primary winding 20 through an interrupter 35, to the primary winding 25 through an interrupter 36, to the ungrounded terminal of the primary winding 26 through an interrupter 37 and, finally, to the ungrounded terminal of the primary winding 39 through an interrupter 38. In this preferred and illustrative embodiment, these interrupters 34, 35, 36, 37 and 38 are electronic switches switches constituted by npn transistors 39, 40, 41, 42 and 43 respectively. These transistors all have their respective collectors connected to the voltage supply line 33. On the other hand, the emitter of transistor 39 is connected to the ungrounded terminal of the primary winding 19, the emitter of transistor 40 to the ungrounded terminal of primary winding 20, the emitter of transistor 41 to the ungrounded terminal of primary winding 25, the emitter of transistor 42 to the ungrounded terminal of primary winding 26 and the emitter of transistor 43 to the ungrounded terminal of primary winding 30. Five timed-pulse signal generators G1, G2, G3, G4 and G5 responsive to a trigger magnet 52 on the rotary disc 49 provide outputs respectively to the base of transistor 30 through a pulse-forming circuit 44, to the base of transistor 41 through a pulse-forming 45, to the base of transistor 35 through a pulse-forming circuit 46, to the base of transistor 37 through a pulse-forming circuit 47 and the base of transistor 38 through a pulse-circuit 48. The rotary disc 49, on the periphery of which the magnetic trigger element 52 is mounted, is driven at half the speed of the gasoline engine by mechanical coupling symbolized by the chain dotted line 51, thorugh a speed reduction gear or converter 50, the disc 49 being caused to turn, therefore, in the direction shown by the arrow R at the proper speed for ignition timing. The pulse generators G1, G2, G3, G4 and G5, as they are excited in turn by the trigger element 52 passing by, respectively deliver trigger signals to the circuits 44, 45 46, 47 and 48 for producing the respective control pulses for the transistors 39, 40, 41, 42 and 43 for first turning on current in the respective primary windings 19, 20, 25, 26, 30 in that order, and then interrupting those respective currents at the respective ignition instants ZG1, ZG2, ZG3, ZG4 and ZG5 shown in the basic schematic diagram, FIG. 2.

Figure 2:
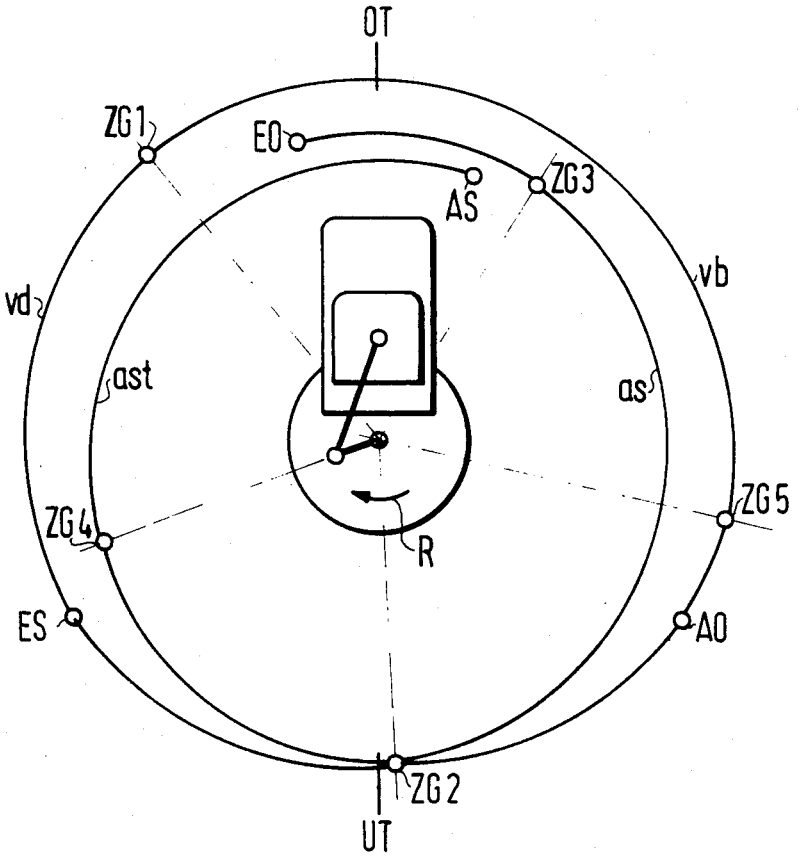
FIG. 2 is a diagrammatic representation of the manner of operation of a five cylinder, four stroke internal combustion engine.

FIG. 2 is a timing diagram with reference to the course of movement of the piston in cylinder 1, showing the upper dead point of that piston at OT, the lower dead point at UT, the closing at ES of the intake valve of cylinder 1 not shown in the drawing, the opening at EO of that intake valve, the closing at AS of the likewise unshown exhaust valve of cylinder 1 and the opening at AO of that exhaust valve. Accordingly, the intake suction stroke is designated by the letters as, the compression stroke by the letters vd, the power stroke by vb and the exhaust stroke by ast, again all for the cylinder 1. The movement of the pistons in the remaining cylinders 2, 3, 4 and 5 can be readily deduced or represented if the ignition instants ZG2, ZG3, ZG4 and ZG5 for these other cylinders are considered as being displaced in the direction of crankshaft rotary movement R, in each case, until the ignition instant for the cylinder under consideration lies where the ignition instant ZG1 of the cylinder 1 is drawn.

It is plain that when ignition pulses in the primary winding pairs 18 and 24, respectively associated with the secondary windings 16 and 22, are be produced in firing sequence, one immediately after the other, for alternately serving secondary windings 16 and 22, it must be assured that no "circuit closure sparks" occur in a cylinder in which air-fuel mixture has already been sucked in or compressed. A circuit closure spark is produced in a sparkplug if the diode connected ahead of these sparkplugs is stressed in its direction of conduction by an induction voltage appearing in the corresponding secondary winding. Such circuit closure sparks sparks appear in the present case at the sparkplug 8 when the primary winding 19 is switched on, likewise at the the sparkplug 6 when the primary winding 20 is switched on, at the sparkplug 9 when the primary winding 25 is switched on and at the sparkplug 7 when the primary winding 26 is switched on. The diode 15 is provided so that no circuit closure spark is produced upon switching on of the primary winding 30. If circuit closure sparks occur in the intake stroke or in the compression stroke of a cylinder, ignition of the air-fuel mixture at a false instant can take place with damage to the engine. The occurrence of such circuit closure sparks at such times is prevented by the circuit of FIG. 1 operated in accordance with the timing shown in FIG. 2.

The two primary windings of each pair 18 and 24 coupled with a single secondary winding 16 or 22 are so poled that they produce ignition pulses of opposite polarity in their common secondry winding.

The ignition system according to FIG. 1 has the manufacturing and installation advantage that in each of the ignition coils having the respective primary pairs 18 and 24, only three external connections, besides the grounding connection, are needed. This is because each of secondary windings 16 and 22 of these ignition coils have their respective high voltage terminals connected to a pair of oppositely poled diodes 7, 13 and 12, 14, for serving pairs of sparkplugs 6, 8 and 7, 9 while the low voltage terminals of these secondary windings are connected to the grounded common connection of the windings of a paired primary winding.

When care is taken to be sure that the current flow intervals in the primary windings 19, 20, 25, 26 and 30, do not overlap one another, it is possible to operate the pulse-forming circuits 44, 45, 46, 47 and 48 by computer control with relatively simple computer programs.

Although the transistors shown in FIG. 1 are illustrated in the usual way for illustrating discrete components, it is to be understood that they may be constituted as portions of an integrated circuit chip which could also include circuit blocks 44, 45, 46, 47 and 48 shown in FIG. 1. Because of the high voltages present, it would probably be desirable for the diodes 11–15 not to be so integrated with low voltage circuitry unless suitably isolated or insulated circuit paths are provided.

It will, furthermore, be evident that although the invention has been described with reference to a particular illustrative example, further variations and modifications are possible within the inventive concept.

What is claimed is:

1. Ignition system for a five-cylinder, four-stroke internal combustion engine having a source of direct current and having a sparkplug in each of its five cylinders of said engine comprising:

first, second and third ignition coils, said first ignition coil having a secondary winding magnetically coupled to a first primary winding, said second ignition coil having a secondary winding magnetically coupled to a second and a third primary winding and said third ignition coil having a secondary winding magnetically coupled to a fourth and a fifth, primary winding, each of said windings having a grounded end connected to a massive metal structural part of said engine and having an ungrounded end, said ungrounded end of said secondary winding of said first ignition coil being connected for supplying sparks to a first of said sparkplugs, said ungrounded ends of said secondary windings of said second and third ignition coils each being connected through diodes of opposite polarity respectively to two of said sparkplugs not connected to any other of said ignition coil secondary windings, and control circuit means including ignition control switches for said respective primary windings for turning on and off connections of said respective primary windings to said current source and also including sources of trigger pulses timed in the firing order for said sparkplugs for respectively timing the operation of said ignition control switches in said firing order;

the windings of each pair of primary windings respectively coupled to said secondary windings of said second and third ignition coils being so wound and connected that the turnings on of the two windings of each said pair by the ignition control switches connected thereto respectively produce high voltage ignition pulses of opposite polarity.

2. Ignition system according to claim 1, in which the interconnections of said control circuit means and the windings of said pairs of primary windings is such that the switchings of said fourth and fifth primary windings respectively follow the corresponding switchings of said second and third primary windings, switching of said first primary winding following the corresponding switching of said fifth primary winding and preceding the corresponding switching of said second primary winding.

3. Ignition system according to claim 1, in which a diode is interposed between the ungrounded end of the secondary winding of said first ignition coil and said first sparkplug.

4. Ignition system according to claim 2, in which a diode is interposed between the ungrounded end of the secondary winding of said first ignition coil and said first sparkplug.

5. Ignition system according to claim 1, in which a common ground connection is provided for said second and third primary windings and the secondary winding of said second ignition coil and a common ground connection is provided for said fourth and fifth primary windings and the secondary winding of said third ignition coil.

6. Ignition system according to claim 1, in which said control circuit means are so constituted that the current flow intervals of said respective primary windings do not overlap.

* * * * *